US008652372B2

(12) United States Patent
Kim

(10) Patent No.: US 8,652,372 B2
(45) Date of Patent: Feb. 18, 2014

(54) METHOD FOR PRODUCING SINGLE COAL COMPACTS SUITABLE FOR COKE CHAMBERS

(75) Inventor: Ronald Kim, Essen (DE)

(73) Assignee: Thyssenkrupp Uhde GmbH, Dortmund (DE)

( * ) Notice: Subject to any disclaimer, the term of this patent is extended or adjusted under 35 U.S.C. 154(b) by 220 days.

(21) Appl. No.: 13/255,475

(22) PCT Filed: Feb. 19, 2010

(86) PCT No.: PCT/EP2010/001049

§ 371 (c)(1),
(2), (4) Date: Sep. 19, 2011

(87) PCT Pub. No.: WO2010/102714

PCT Pub. Date: Sep. 16, 2010

(65) Prior Publication Data

US 2011/0314727 A1 Dec. 29, 2011

(30) Foreign Application Priority Data

Mar. 12, 2009 (DE) ..... 10 2009 012 453

(51) Int. Cl.
*C10L 5/06* (2006.01)
*B29C 43/02* (2006.01)

(52) U.S. Cl.
USPC ..... 264/109; 264/115; 44/596; 44/636; 425/416

(58) Field of Classification Search
None
See application file for complete search history.

(56) References Cited

U.S. PATENT DOCUMENTS 7,611,609 B1 * 11/2009 Valia et al. ..... 201/5
7,815,829 B2 10/2010 Schuecker

FOREIGN PATENT DOCUMENTS

| | | | |
|---|---|---|---|
| DE | 513359 | C | 11/1930 |
| DE | 638114 | C | 11/1936 |
| DE | 19545736 | A1 | 6/1997 |
| JP | 59076542 | U | 5/1984 |
| WO | 2006056286 | A1 | 6/2006 |
| WO | 2007149642 | A2 | 12/2007 |

OTHER PUBLICATIONS

International Search Report for PCT/EP2010/001049, Completed by the European Patent Office on Sep. 16, 2010, 6 Pages.
Wright et al.(2005) "Compacting of coal for heat recovery ovens illawarra coke company pty ltd coalcliffe, nsw, australia", Web site: http://www.coke-oven-managers.org/PDFs/2006/compact_coal.pdf, 11 Pages.

* cited by examiner

*Primary Examiner* — Mary F Theisen
(74) *Attorney, Agent, or Firm* — Brooks Kushman P.C.

(57) ABSTRACT

Coal compacts which are suitable for coking in coke oven chambers are prepared by pressing and compacting coal in a pressing device having a design which shapes the surface of the coal compacts to provide higher surface area. Already compacted coal blocks can be pressed to generate the surface shape. The resulting coal compacts exhibit significantly improved properties during the coking process, resulting in improved gas and heat exchange. A device for compacting coal preferably contains a plate provided with shaping elements on the pressing surface.

10 Claims, 2 Drawing Sheets

METHOD FOR PRODUCING SINGLE COAL COMPACTS SUITABLE FOR COKE CHAMBERS

CROSS-REFERENCE TO RELATED APPLICATION

Figure 1:
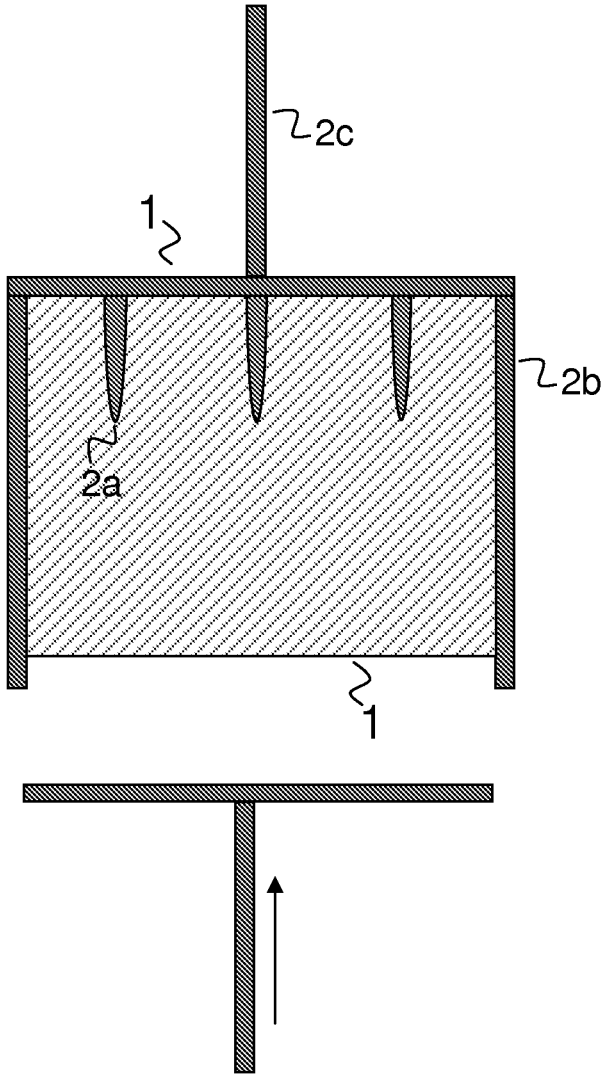

This application is the U.S. national phase of PCT Appln. No. PCT/EP2010/001049 filed Feb. 19, 2010 which claims priority to German application DE 10 2009 012 453.5 filed Mar. 12, 2009, the disclosure of which is incorporated in its entirety by reference herein.

BACKGROUND OF THE INVENTION

1. Field of the Invention

The invention relates to a method for coke oven chamber suitable compacting of coal by pressing, said compacts on their surface being provided with a shape offering an enhanced area for heat exchange and for degassing of carbonization products so that the process of coal carbonization takes substantially less time. The invention also relates to a device for pressing of coal which presses coal into a compacted form, said device being comprised of a plate provided with moulding elements on the pressing surface so that the compacts attain the desired shape of the surface.

2. Description of the Related Art

Coal carbonization is frequently confronted with a problem in that coal is charged into coke oven chambers and the coal cake cannot be provided in precisely measured portions. The required quantity of coal is given into a charging machine wherein the coal is pressed and after this pressing process the coal charge is transported into the coke oven chamber. By way of this mode, a compact coal cake is obtained which is not structured on the surface and which therefore offers little surface area for the exchange of heat and for degassing of gaseous coal carbonization products during the process of coal carbonization.

A process mode of coal compacting is often applied with the aim to increase the efficiency of coke oven chambers. Accordingly, coal is pressed so that coal cake densities reaching 1200 kg/m$^3$ are obtained. The specific performance rate of coke ovens can thereby be increased. At the same time, however, the coking time of coke oven chambers is extended. The reason is that the crude gas required for combustion is admitted with some delay in time into the burner chamber, thus slowing down the combustion of coking gas. Hence it would be of some advantage if channels or surface structures were introduced into the coal cake. In this manner, the coking gas can more quickly escape from the coal cake and the effect of an increase in performance rate by coal compacting can be maintained and safeguarded.

By introducing slotted or round channels into the coal cake, its specific surface is substantially enhanced, and thereby the coking gas is better supplied to the combustion process in the burner chamber. This leads to a substantial decrease in coking time. Another advantage would be providing coal in compacted form in precisely measured portions or compacts so that these can be given in form of pieces in a certain number into the coke oven chamber, with the number of pieces determining the quantity of coal.

Charging of coke oven chambers to be loaded horizontally is described in DE 19545736 A1. Coal is shed outside the oven onto a planar base plate, compacted and gently pushed into a coke oven chamber. Subsequently the base plate is pulled out from the coke oven chamber whilst keeping the coal cake firm at its front end side. The production of pressed coal cakes by applying suitable devices is described in WO 2006/056286 A1. Applying the method described in this teaching, a coal cake is moulded in a press mould by means of stationary pressing tools which work horizontally and which compact the coal cake before it is loaded into the coke oven chamber. But precisely measured coal portions are not provided for. Nor is a method mentioned by which the surface of coal compacts is structured accordingly. Thus the coal to be carbonized neither has any subdivision into distinct portions nor a surface by way of which an improved exchange of heat is achieved.

SUMMARY OF THE INVENTION

Now, therefore, it is the object of the present invention to provide a method by means of which coal supplied for coal carbonization is provided in precisely measured portions. These portions should have an outer surface that is enhanced, thus allowing for improved exchange of heat in the coke oven chamber and for improved degassing of coal carbonization products.

The invention achieves this object by providing a method by means of which coal envisaged for coal carbonization is pressed with pressing devices into compacts and then compacted. By way of this pressing mode, the coal compacts attain a shape on the surface that is not planar, thus allowing for improved exchange of gas from coking gases and for improved exchange of heat with the environment. Moulding is enabled by a special configuration of the pressing tools which on their surface have a moulding structure.

DETAILED DESCRIPTION OF THE PREFERRED EMBODIMENTS

The pressing device preferably is a plate, although a semi-spherical or funnel-shaped structure is also possible. Accordingly, the pressing device designates the moulding element which on its rear side is provided with devices exerting a certain pressure, thus being pressed onto the coal.

Claim is laid in particular to a method for coke oven chamber suitable compacting of coal by pressing, wherein coal is pressed and compacted with a suitable pressing device into one or several coal compacts, and which is characterized in that the pressing device has a moulding that shapes the surface of the coal compacts whilst being pressed.

In this manner, coal is directly pressed into the desired compacts. The assumption taken here is that the coal is a loose bulk coal and that it can be compacted. Compaction densities being as high as up to 1200 kg/m$^3$ are achieved by these compacting processes. But it is also feasible to apply this method on already compacted coal if it can still be pressed sufficiently and if it can be provided with a structured surface by applying the moulding elements. In particular, a coal compact can be prepared by cutting and dividing a pre-pressed coal cake and by subjecting it subsequently to the inventive moulding. The production of the compact and the method for the production of the compact are of no further significance inasmuch as the compact is subjected to the inventive moulding process.

Any arbitrary moulding elements can be utilized as moulding elements. Particularly suitable are press-in stingers which are mounted on the moulding element. These can be mounted in any arbitrary number on the pressing device. If the pressing device is a plate, then for example several press-in stingers are welded onto this plate. By way of the pressing process applied on the surface of the coal compacts, channels running vertically or nearly vertically into the coal and through which the coking gas can escape are thus obtained. In a top view, the channels are preferably of a slotted or round shape. If required, the coal cake can be entirely pierced through.

However, elevations comprised of truncated cones and thus generating a dotted wave pattern on the coke compacts are suitable, too. These may originate from the elevations mounted on the plates and pressed into the compacts. For this purpose, press-in elevations are pressed-in as moulding elements on the plates. The patterns pressed into the compacts may also represent longitudinal waves or trenched patterns. The pressed-in patterns can be chosen arbitrarily as long as they elevate the surface and allow for improved exchange of gas and heat with the environment.

The pressing device is preferably comprised of a plate onto which the moulding elements are mounted. But the pressing device may also be comprised of an arched plate, a funnel or a semi-shell. It can impact onto a coal cake from one side or from several sides. If the pressing device is a plate, then it may be provided with plates mounted perpendicularly on it from one side or from several sides. If four plates are perpendicularly mounted on it, then an enclosure is created thereby which has moulding elements at the inner walls. This can be filled for compacting and be pressed with another moulding plate. Finally, the number of pressing plates and sides is arbitrary as long as the desired compacts can thereby be produced. The moulding elements can be combined arbitrarily both in terms of their number and in terms of their shape, too.

The cokemaking process operated with the compacts produced in conformity with the inventive method does not differ from state-of-the-art cokemaking processes. In preparation for the cokemaking process, the compacts produced in accordance with the invention can be piled-up and compiled arbitrarily. If the weight of the individual compacts is standardized and known, one can dispense with an extensive weighing of coal to be carbonized. The coke cake obtained after the cokemaking process does not have any properties different to those obtained from a coke cake treated with the inventive method.

The inventive method which is executed with the pertinent device bears the advantage of producing coal compacts that can be charged in precisely measured portions into a coke oven chamber for coal carbonization. As compacts, these portions have substantially improved properties in relation to the cokemaking process, which becomes particularly evident by a shortened coking time and an improved coal quality.

The inventive device is explained by way of two drawings, these drawings just representing an exemplary embodiment for the design and construction of the inventive device.

FIG. 1 shows the pressing of coal (1) with a pressing device designed and configured as a plate (2) and provided with press-in stingers (2*a*). Thereby, the coal compacts receive channels running perpendicularly into the coal compact. Here, one can also see two lateral plates (2*b*) mounted perpendicularly onto the plate and retaining the coal cake in the required shape. Further plates mounted perpendicularly onto the moulding plate and retaining the coal cake for pressing may be situated above and below the plane level. The stay-bar (2*c*) for the plate can also be seen here.

Figure 2:
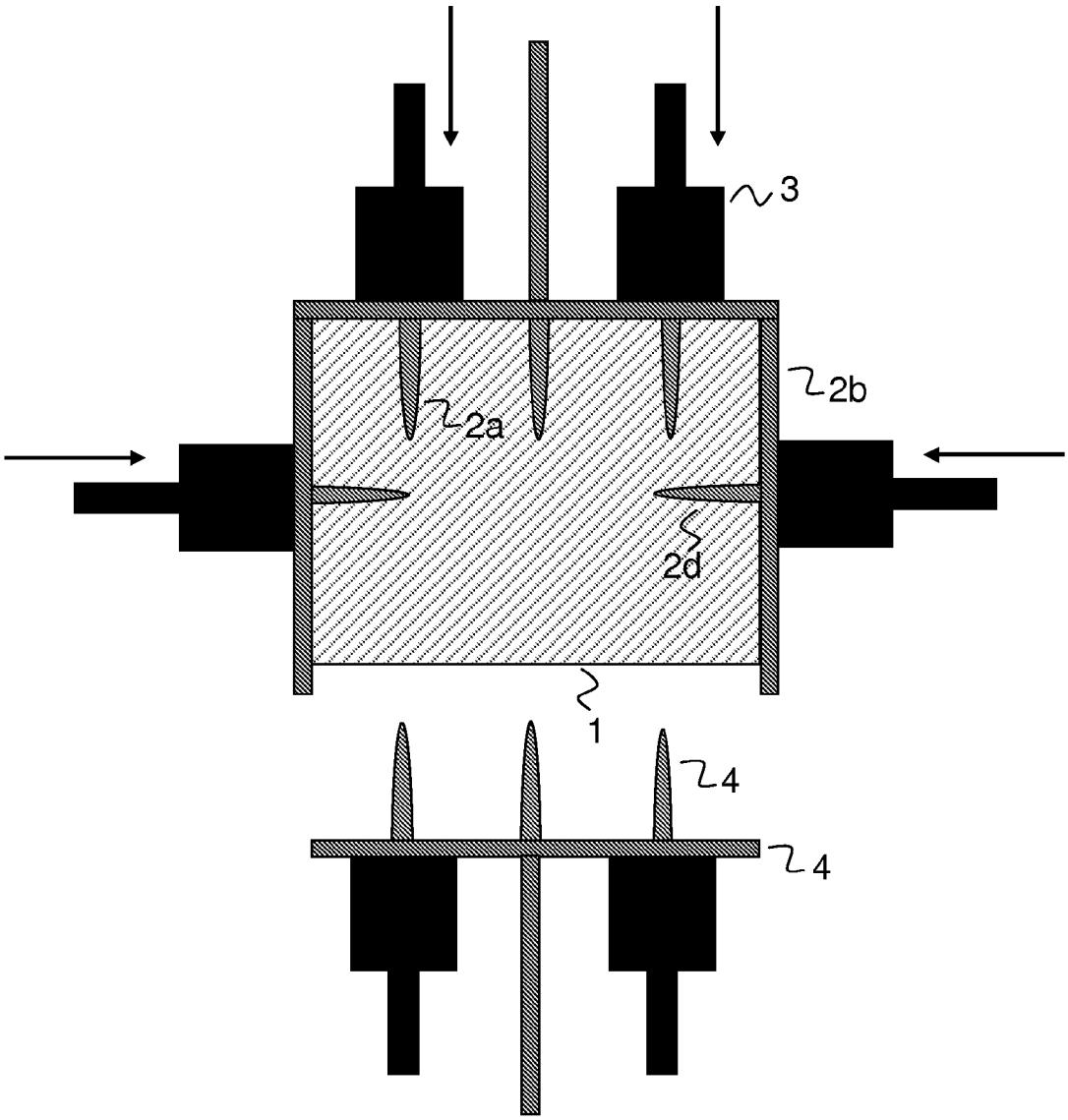

FIG. 2 shows the pressing of coal (1) with a device also designed and configured as a plate (2) and provided with press-in stingers (2*a*). The laterally mounted plates (2*b*), too, bear press-in stingers (2*d*). Here one can also see the pressing mechanism (3), which for example may be represented by a hydraulic press. Further plates mounted perpendicularly onto the moulding plate and also provided with press-in stingers may be situated above and below the paper plane. For pressing, the enclosure thus formed is filled with coal (1), and finally, proceeding from the closing side, it receives a distinct press-in pressure by applying a frontal pressing device (4). This frontal side, too, is provided with press-in stingers (4*a*).

LIST OF REFERENCE SYMBOLS

1 Coal
2 Plate
2*a* Press-in stingers
2*b* Laterally mounted plate
2*c* Stay-bar
2*d* Press-in stingers
3 Pressing mechanism
4 Frontal pressing device
4*a* Press-in stingers

The invention claimed is:

1. A method for compacting coal into coal compacts which exhibit reduced coking time in a coke oven chamber, comprising pressing and compacting coal with a moulding pressing device into one or a plurality of coal compacts, wherein the moulding pressing device comprises a mould that shapes the surface of the coal compacts to provide a structured shape on the surface that is not planar and thus possesses an increased surface area in comparison to coal compacts which are not structured on the surface, and the moulding pressing device is provided with plates mounted perpendicularly on it from four sides so that an enclosure is created which is filled for compacting and pressed with other moulding plates, and the laterally mounted plates also bear structure-providing moulding elements at the inner walls and the plate on the non-frontal side of the coal cake is also provided with structure-providing moulding elements.

2. The method of claim 1, wherein the coal compacts are produced from a compacted coal block by cutting it apart and then pressing with the moulding pressing device.

3. The method of claim 1, wherein the coal is compacted to a compacting density of up to 1200 kg/m$^3$.

4. The method of claim 1, wherein the moulding pressing device provides coal compacts with a wavy surface.

5. The method of claim 1, wherein the moulding pressing device provides the coal compacts with channels that extend into the coal compacts.

6. The method of claim 5, wherein the moulding pressing device provides the coal compacts with slotted or round channels extending into the coal compacts.

7. The method of claim 5, wherein the channels extend totally through the coal compacts.

8. A device for compacting of coal into coal compacts suitable for use in a coke oven chamber by the method of claim 1, comprising a device which supplies coal to a moulding pressing device, the moulding pressing device comprising a plate with moulding elements extending therefrom.

9. The device of claim 8, wherein one or several press-in stingers are mounted on the plate.

10. The device of claim 8, wherein press-in elevations are mounted on the plate.

* * * * *